United States Patent [19]

Boswell

[11] Patent Number: 5,031,916

[45] Date of Patent: Jul. 16, 1991

[54] TEE AND GREEN STRUCTURES FOR A GOLF-TYPE GAME

[76] Inventor: James W. Boswell, 1196 Carriage Way N., East Lansing, Mich. 48823

[21] Appl. No.: 535,370

[22] Filed: Jun. 8, 1990

[51] Int. Cl.[5] ..... A63B 67/02; A63B 69/36; A63B 71/02

[52] U.S. Cl. ..... 273/176 H; 273/195 B

[58] Field of Search ..... 273/176 R, 176 A, 176 AB, 273/176 B, 176 E, 176 F, 176 G, 176 H, 176 J, 181 R, 181 A, 195 B, 35 B

[56] References Cited

U.S. PATENT DOCUMENTS

| | | | |
|---|---|---|---|
| 1,612,291 | 12/1926 | Jackson | 273/176 H |
| 3,522,947 | 8/1970 | Anderson et al. | 273/176 H |
| 3,595,581 | 7/1971 | Anderson et al. | 273/176 H |
| 3,690,673 | 9/1972 | Occhipinti | 273/176 H |
| 3,693,979 | 9/1972 | Koett | 273/195 B |
| 3,831,949 | 8/1974 | Henning | 273/176 H |
| 4,222,568 | 9/1980 | Russo | 273/176 H |
| 4,613,133 | 9/1986 | Selberg et al. | 273/195 B |
| 4,790,538 | 12/1988 | Gettelfinger | 273/176 H |

OTHER PUBLICATIONS

"Now That's Stadium Golf", Golf Digest, Mar. 1987, p. 14.

*Primary Examiner*—William H. Grieb

*Attorney, Agent, or Firm*—Harness, Dickey & Pierce

[57] ABSTRACT

A tee and green structure for a game to be played within the confines of an open-air or domed sports arena. The tee structure includes a hitting tee mounted on a rail system which enables the orientation of the tee surface to be altered. Included in the rail system is a plurality of ties and a pair of substantially parallel rails which engage a correspondingly constructed wheel assembly of the hitting tee. The hitting tee includes a frame which supports a hitting deck over which grass sod is positioned. At the opposing end of the arena's playing field is a green structure surrounded by various playing hazards. The green structure is also movable and includes a putting surface formed by a seamed carpet positioned over an elevated putting deck. The deck is elevated by a plurality of upright supports varying in height and having angled upper surfaces. The upright supports extend from and are secured to a support frame. The upper angle of the surfaces and the height of the upright supports thus induce intricate contours and elevational changes into the putting surface making for a challenging game.

14 Claims, 2 Drawing Sheets

TEE AND GREEN STRUCTURES FOR A GOLF-TYPE GAME

BACKGROUND AND SUMMARY OF THE INVENTION

The present invention is a tee and green structure for a golf-type game to be played within the confines of an open-air or domed sports arena. More particularly, the present invention includes a movable tee structure positioned on a track which alters the position and slope of the tee structure relative to a contoured green structure positioned at the opposite end of the arena's playing field. The green structure is also movable.

Over the past several decades the game of golf has experienced a substantial increase in popularity. This is evidenced by the increasing number of participants in the sport, the number of new golf courses opening annually, and the increasing popularity of the professional tours and amateur circuits.

While golf is traditionally played in the natural fairways, deep roughs, and vast expanses of the world's numerous courses, the expense of playing on such courses has increased dramatically along with the sport's own popularity. With this in mind, Applicant of the present invention foresees a shift in the nature of the game. Like numerous sports before it, including football, basketball, baseball, hockey, soccer and even lacrosse, the game of golf will move to a venue having spectatorial advantages. More precisely, a version of the game of golf will be played on the fields of the open-air or domed sports arenas. One such game to which the present invention is particularly adapted is "Stadium Golfball". The official rules of the game have been copyrighted by the Applicant of the present invention.

It is therefore, an object of the present invention to provide a tee structure for use in an arena version of the game.

It is an additional object of the invention to provide a green structure which may also be used in an arena setting for the game.

Another object of the present invention is to provide tee and green structures capable of being adjusted to alter the positioning of their respective playing surfaces so as to simulate the varying terrain and the different possible lies occurring on a natural golf course.

The tee structure includes a hitting tee which is movable upon a track or rail system. By moving the tee structure along the rail system, the orientation of the playing surface of the hitting tee is altered. In this manner, the hitting tee can simulate a level lie, a downward slope, an upward slope and even a compound slope varying to the left or right.

The green structure is positioned opposite of the tee structure at the remaining end of the arena's playing field. The green structure is also movable and may be protected by various hazards, including sandtraps, grass bunkers and water hazards. The green structure itself includes a large elevated putting surface having numerous intricate contours designed to provide both a challenging read and putt for the golfer. The putting surface is supported by a number of upright supports having angled upper surfaces. It is these surfaces which induce the contours of the putting surface. To create the putting surface, a decking is positioned on the upright supports A layer of foam rubber is then secured over the decking, followed by a seamed carpet of a material such as artificial grass, to provide a natural action to the golf ball. The interior of the green structure may be filled with styrofoam sheets to deaden the sound of a golf ball impacting on the putting surface. The styrofoam further provides a natural action to the golf ball as well as interior support when walked upon.

Additional benefits and advantages of the present invention will become apparent to those skilled in the art to which this invention relates from the subsequent description of the preferred embodiments and the appended claims, taken in conjunction with accompanying drawings.

DETAILED DESCRIPTION OF THE DRAWINGS

Figure 1:
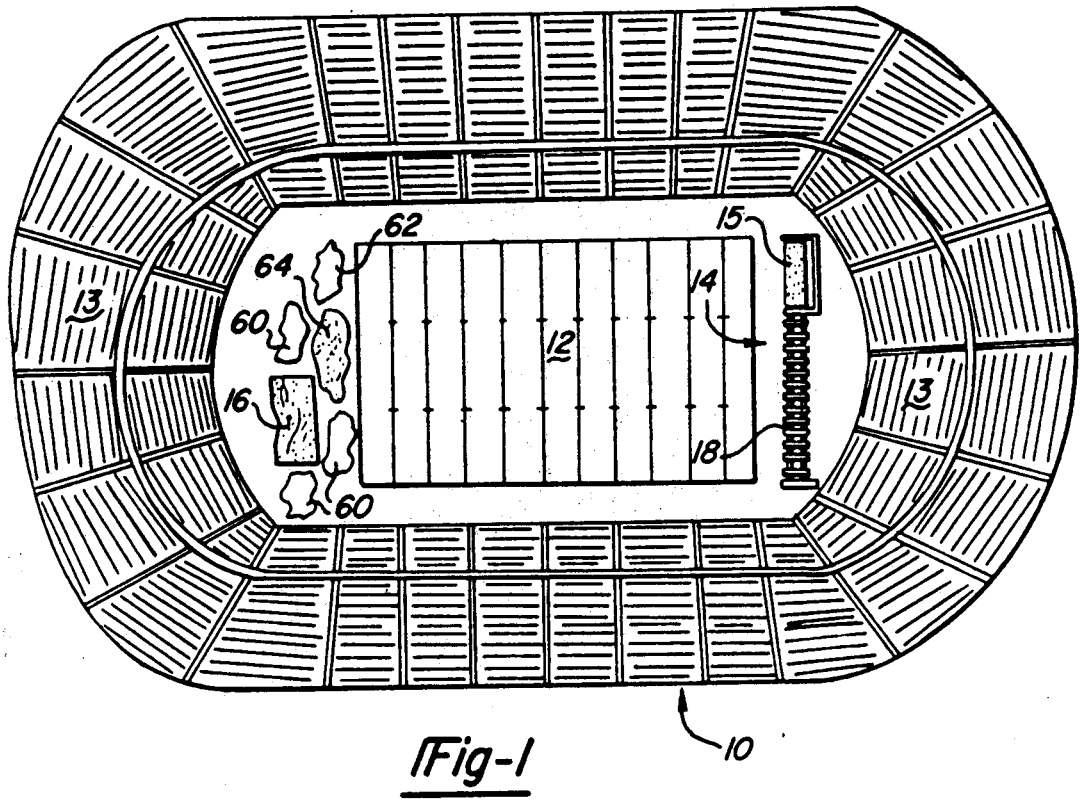
FIG. 1 is a plan view of a sports arena into which the tee and green structures of the present invention have been incorporated.

Now with reference to the drawing, FIG. 1 illustrates a sports arena 10 having a large spectator area 13 and a playing field 12 which incorporates a tee structure 14 of the present invention at one end of the playing field 12 and a green structure 16 of the present invention at the remaining end.

The tee structure 14 includes a hitting tee 15 which is movably mounted on a track system 18 including rails 34 and a plurality of ties 22. The ties 22 are positioned in a spaced apart, substantially parallel, side-by-side fashion so as to somewhat resemble a railroad track. Each tie 22 has an upper surface 23 exhibiting a predetermined sloped orientation.

Figure 2:
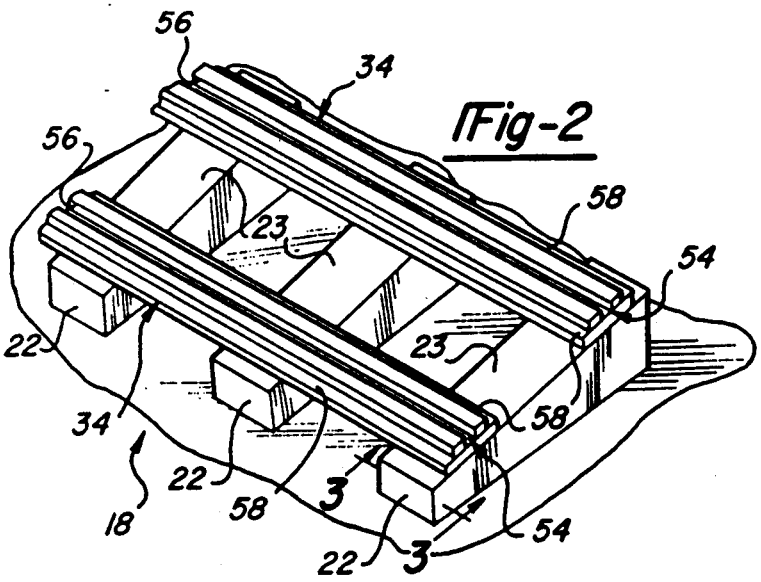
FIG. 2 is a partial perspective view of the track system upon which the hitting tee is movably mounted.
Figure 3A:
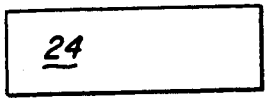
FIGS. 3(*a*)–(*e*) illustrate sectional views of five possible slope orientations for the ties of the track system as would be seen from a section taken substantially along line 3—3 in FIG. 2.
Figure 3B:
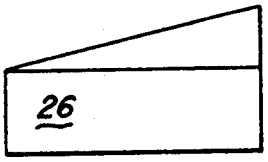
Figure 3C:
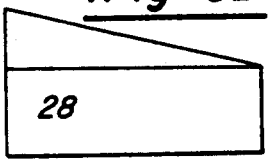
Figure 3D:
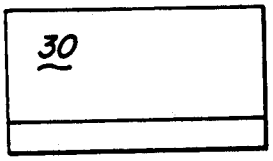
Figure 3E:
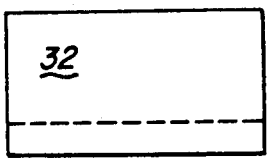
Figure 4:
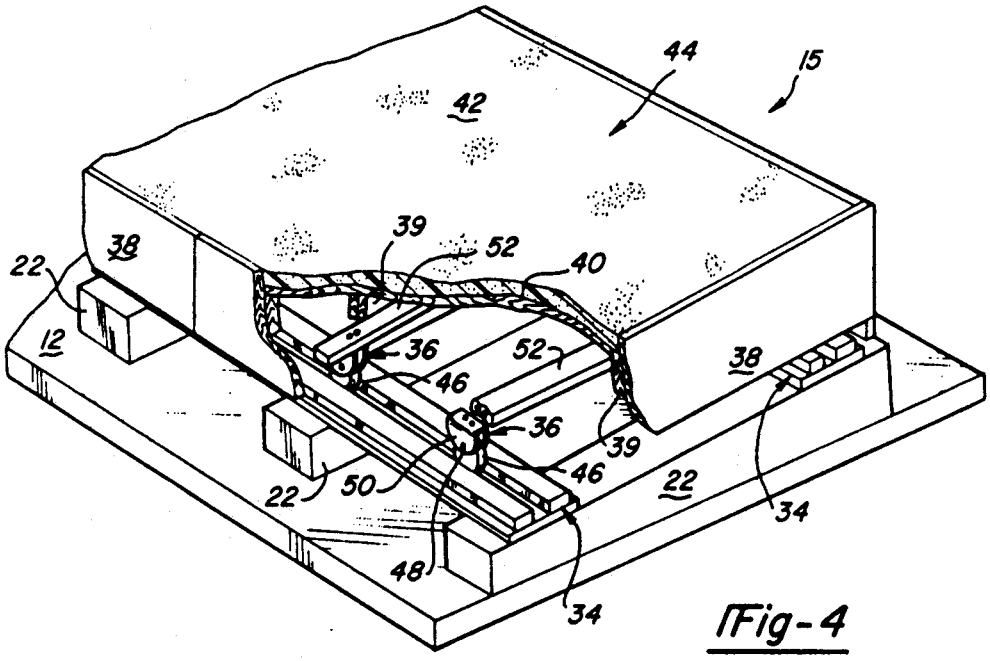
FIG. 4 is a perspective view of the hitting tee of the present invention having a portion broken away so as to illustrate the frame and wheel assemblies.

Five basic slope orientations for the ties 22 are illustrated in FIGS. 3(*a*)–(*e*). While the ties 22 exhibited in FIG. 2 are illustrative of the slope orientation in FIG. 3(*d*), the remaining views of FIGS. 3(*a*)-(*e*) are all representative sectional views taken substantially along line A—A in FIG. 2. In FIG. 3(*a*) the tie 24 is uniformly flat across its upper surface 23 and exhibits no slope. The tie 26 of FIG. 3(*b*) exhibits a positive or upward slope from left to right. The tie 28 illustrated in FIG. 3(*c*) is the converse of the tie 26 in FIG. 3(*b*) and exhibits a negative or downward slope from left to right. A lengthwise upward slope, from end to end, is illustrated by the tie 30 of FIG. (*d*). The converse of this is shown in FIG. 3(*e*) where the tie 32 exhibits a lengthwise downward slope. By respectively combining the slope orientations of FIGS. 3(*d*) and 3(*e*) with the slope orientations of 3(*b*) and 3(*c*) respectively, thus creating a compound slope in each tie 22, nine basic slope orientations can be achieved. This number may then be infinitely expanded upon by varying the degree with which each tie 22 is actually sloped.

In a preferred embodiment, a total of 54 ties are used to extend across the width of the playing field 12. The present embodiment is shown incorporated into a sports arena 10 having a football playing field 12 and therefore the track system 18 will extend a distance of approximately 216 feet. The ties 22 would thus be positioned approximately four feet apart. If desired, the track system 18 may be further lengthened to also extend a distance along the length of the playing field 12. For reasons further described below, the ties 22 are additionally arranged in groups of three, with each tie 22 in a group exhibiting a common slope orientation.

Supported on the ties 22 is a pair of parallel rails 34 which extend the width of the playing field 12. As further described below, the configuration of the rails 34 is constructed so as to engage a corresponding wheel assembly 36 of the hitting tee 15. The rails 34 thus direct the hitting tee 15 along the track system 18 when it is moved. The hitting tee 15 itself includes a generally rectangular frame 38 which, for construction purposes is divided into three identical four-by-eight foot sections 39. A decking 40, constructed of four-by-eight foot sheets of plywood, is supported and rigidly mounted to the section 39 of the frame 38. Grass sod 42 is positioned on the top of the decking 40 and provides a textured and well manicured tee surface 44.

Each section 39 of the frame 38 is provided with two wheel assemblies 36 mounted beneath the hitting tee 15. Each wheel assembly 36 includes a pair of wheels 46 positioned on an axle 48 which is rotatably mounted in a support member 50. The support member 50 is rigidly mounted by bolts or other conventional means to a runner board 52 which extends crosswise of the hitting tee 15 and provides further rigidity thereto. The support members 50 are positioned on the runner board 52 so as to align each wheel 46 with one of the corresponding rails 34.

As mentioned previously, the wheels 46 and rails 34 are constructed so that each wheel 46 is maintained in engagement with a rail 34 and the hitting tee 15 rides on the track system 18. In the present embodiment, the rail 34 are provided with a central groove 54 in which the wheels 46 are received. The central groove 54 has a width slightly larger than that of the wheel 46 and therefore permits the wheel 46 to smoothly roll therein. The depth of the central groove 54 must be sufficient so as to prevent the wheels 46 from derailing in the event of contact with a side wall 56 of the central groove 54. Each rail 34 may be further provided with lateral flanges 58 that enable the rails 34 to be readily mounted to the ties 22 by conventional fasteners.

As the overall length of the hitting tee 15 and the positioning of the ties 22 indicate, at any given time, the hitting tee 15 is supported directly above three ties 22 of the track system 18. With each group of three ties 22 exhibiting a common slope orientation, the surface 44 of the hitting tee 15 is sloped in a manner corresponding to the slope orientation of the ties 22 over which it is positioned. Thus, it is readily seen that by moving the tee structure 14 a distance corresponding to three ties 22, the orientation of the tee surface 44 is altered. Having a total of 54 ties positioned across the width of the playing field 12, a total of eighteen varying tee positions are formed.

In moving the hitting tee 15, numerous means may be employed including a tractor, winch, or other mechanism. In the event that a tractor is employed, wooden planks may also be secured to the ties 22, between the rails 34, to provide a smooth riding surface for the tractor wheels.

In using the tee structure 14, the hitting tee 15 is first properly oriented and a golf ball is either dropped onto the tee surface 44 to simulate a fairway shot or teed up to simulate a tee shot. A golfer, using an appropriate golf club, then hits the golf ball in an attempt to safely land it on the green structure 16 positioned at opposing end of the playing field 12. As is common on a natural golf course, the green structure 16 may be protected by numerous hazards. These hazards may include sandtraps 60, grass bunkers 62, water hazards 64 or various other hazards. Thus, as is common in the more traditional game, an errant approach shot to the green structure 16 will result in the golfer having to display precise control over his short game so as to get up and down in two and save par.

Replicating a natural green, the green structure 16 of the present invention is of a considerable size and exhibits an intricately contoured putting surface 66. The putting surface 66 is a seamed carpet 68 of artificial grass or like material mounted over the decking 70. Positioned between the decking 70 and the seamed carpet 68 is a layer of foam rubber 71. The foam rubber 71 provides the putting surface 66 with a natural give that allows a well played golf ball exhibiting backspin to bite or be drawn toward a cup 72. The cup 72 is mounted in a hole 73 in the putting surface 66. The cup 72 is of a size larger than a golf ball and may correspond to the size traditionally used in the game of golf.

The decking 70 of the putting surface 66 is mounted a predetermined distance above a support frame 74 by a plurality of upright supports 76. A number of four-by-eight foot rectangular sub-frames 78 are interconnected to construct the support frame 74 to a size generally corresponding to that of the desired putting surface 66. Adjacent members of the sub-frames 78 are secured together by H-flanges 80 through which nut and bolt fasteners 82 are extended. The H-flanges 80 and additional nut and bolt fasteners 82 also secure the upright supports 76 in position on the frame 74.

Figure 5:
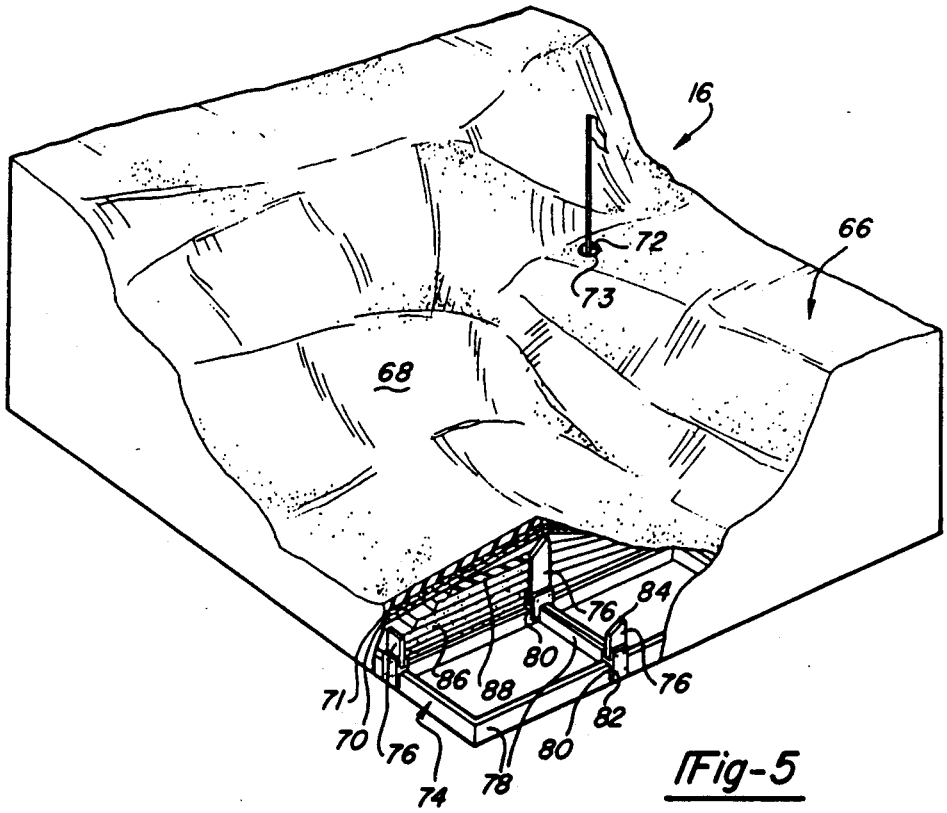
FIG. 5 is a perspective view of the green structure illustrating the myriad of contours on the putting surface and having a portion broken away showing the specific structure of the present embodiment.

The height of the upright supports 76 is varied and each upright support 76 has an upper surface 84 to which the decking 70 is secured. Each upper surface 84 is angled, either in a singular angle or in a compound one, and in conjunction with the height of the upright support 76 enables the putting surface 66 to be formed with the desired intricate contours. The contours of the putting surface 66 are shown in FIG. 5 in an exaggerated state for illustrated purposes only and are not intended to indicate scaled dimensions.

The green structure 16 is also internally filled with sheets of styrofoam 86, or other acoustically insulative material, and a second sheet of foam rubber 88 is placed on top thereof. The styrofoam sheets 86 and the second foam rubber sheet 88 provide an additional give to the green structure and absorb excessive sounds which would otherwise be produced from a golf ball landing on a hollow green structure 16.

As previously mentioned the green structure 16 is also movable. While the green structure 16 could be mounted on a track system 18 analogous to that of the tee structure 14, in the preferred embodiment the green structure 16 is slidable across the playing field 12 along the support frame 74. In this manner, the support frame 74 itself acts as a sled. A tractor, winch, or other mechanical device may be employed to move the green structure 16. Such a construction provides additional rigidity to the green structure 16 which would not be achievable in a wheel mounted structure.

While the above description constitutes the preferred embodiments of the present invention, it will be appreciated that the invention is susceptible to modification, variation and change without departing from the proper scope and fair meaning of the accompanying claims.

I claim:

1. A tee and green assembly for a golf-type game to be played within the confines of an open-aired or domed sports arena having a playing surface, the assembly comprising:

a tee structure positioned at one end of the playing surface, said tee structure having an elevated hitting surface from which a golf ball may be hit, said surface mounted upon a moveable frame having means for moving said frame across said playing surface, said tee structure having means for altering the orientation of said hitting surface relative to said playing surface upon the movement of said tee structure across said playing surface; and a green structure positioned at the opposing end of said playing surface and being surrounded by a plurality of hazard structures, said green structure having an elevated contoured putting surface upon which a golf ball may be landed, said putting surface being supported on a frame having means for moving said green structure across said playing surface, said putting surface further having a portion defining an annular opening having a closed bottom and side walls, said annular opening being of a size capable of receiving a golf ball putted across said contours of said putting surface and into said opening.

2. A tee and green assembly for a golf-type game to be played within the confines of an open or domed sports arena having a playing field, the assembly and comprising:

a tee structure positioned on the playing surface of the arena and including a tee platform movably mounted on a track, said track including a plurality of ties having sloped upper surfaces and being positioned in a substantially side-by-side relation, a plurality of rail members supported on said upper surfaces of said ties and extending generally crosswise of said ties, said tee platform being movable on said rails and further having a structural frame, a hitting deck mounted on said structural frame, and a plurality of wheel assemblies secured to said tee platform and including an axle and wheel rotatably mounted thereon, said wheel assemblies being correspondingly positioned and said wheels being constructed so as to enable said tee platform to ride upon said rail members thereby causing said hitting deck to exhibit elevational changes in positioning as said tee platform is moved along said track; and a green structure including a generally horizontal support frame, a plurality of upright supports secured to said frame and extending upward therefrom until terminating at upper surfaces, a putting deck positioned on said upper surfaces and secured to said upright supports, said upper surfaces further being angled such that said platform exhibits a contoured surface of varying slope, a portion of said putting deck defining an annular opening of a predetermined size and a closed bottom cup positioned and mounted in said opening.

3. A tee and green assembly as set forth in claim 1 wherein said rail members each include a portion defining a central groove therein and said wheels being constructed so as to ride in said groove.

4. A tee and green assembly as set forth in claim 1 wherein said upper surfaces of said ties exhibit a transverse slope.

5. A tee and green assembly as set forth in claim 1 wherein said upper surfaces of said ties exhibit a longitudinal slope.

6. A tee and green assembly as set forth in claim wherein said upper surfaces of said ties exhibit a zero slope.

7. A tee and green assembly as set forth in claim 1 wherein said ties are further positioned such that three consecutive ties exhibit a substantially similar slope and thereby cause said tee platform to assume one tee position.

8. A tee and green assembly as set forth in claim 7 having eighteen tee positions.

9. A tee and green assembly as set forth in claim 1 wherein said hitting deck and said putting deck are covered by a textured material.

10. A tee and green assembly as set forth in claim 9 wherein said textured material is sod.

11. A tee and green assembly as set forth in claim 9 wherein said textured material is artificial grass.

12. A tee and green assembly as set forth in claim 9 wherein said hitting deck is covered with sod and said putting deck is covered with artificial grass.

13. A tee and green assembly a set forth in claim 1 wherein said green structure further includes a plurality of internally mounted acoustically insulative layers positioned between said frame and said green platform.

14. A tee and green assembly as set forth in claim 9 wherein said hitting deck and said putting deck further include a resilient layer positioned between said hitting deck and said textured material and between said putting deck and said textured materials.

* * * * *

UNITED STATES PATENT AND TRADEMARK OFFICE

CERTIFICATE OF CORRECTION

PATENT NO. : 5,031,916

DATED : July 16, 1991

INVENTOR(S) : James W. Boswell

It is certified that error appears in the above-identified patent and that said Letters Patent is hereby corrected as shown below:

Column 1, line 67, after "supports", kindly insert --.--.

Column 3, line 41, kindly delete "rail" and insert --rails--.

Column 6, line 24, after "claim", kindly insert --1--.

Column 6, Claim 14, line 53, kindly delete "materials", and insert --material--.

Signed and Sealed this

Seventeenth Day of November, 1992

*Attest:*

DOUGLAS B. COMER

*Attesting Officer*

*Acting Commissioner of Patents and Trademarks*